US008562039B2

(12) United States Patent
Ichikawa et al.

(10) Patent No.: US 8,562,039 B2
(45) Date of Patent: Oct. 22, 2013

(54) VEHICLE HANDLE APPARATUS

(75) Inventors: Shinji Ichikawa, Yokohama (JP); Ryuji Minemura, Yokohama (JP)

(73) Assignee: Alpha Corporation, Yokohama-shi, Kanagawa (JP)

( * ) Notice: Subject to any disclaimer, the term of this patent is extended or adjusted under 35 U.S.C. 154(b) by 382 days.

(21) Appl. No.: 12/716,531

(22) Filed: Mar. 3, 2010

(65) Prior Publication Data

US 2010/0230980 A1 Sep. 16, 2010

(30) Foreign Application Priority Data

Mar. 10, 2009 (JP) ..... 2009-056050

(51) Int. Cl.
*E05B 63/20* (2006.01)

(52) U.S. Cl.
USPC ..... 292/336.3; 292/DIG. 30; 292/92

(58) Field of Classification Search
USPC ..... 292/336.3, 348, 347, 352, 354, 357, 292/DIG. 30
See application file for complete search history.

(56) References Cited

U.S. PATENT DOCUMENTS

2007/0069533 A1 * 3/2007 Cummins et al. ..... 292/336.3

FOREIGN PATENT DOCUMENTS

JP 2008-13962 1/2008

* cited by examiner

*Primary Examiner* — Carlos Lugo
*Assistant Examiner* — Mark Williams
(74) *Attorney, Agent, or Firm* — Drinker Biddle & Reath LLP

(57) ABSTRACT

A door handle apparatus for a vehicle is provided with a handle base to be fixed to a door of the vehicle and an operating handle. One end of the operating handle is pivotally coupled to the handle base. On the other end of the operating handle, an operating leg protrudes. The operating leg portion includes a stopper protrusion for butting with a part of the handle base to define a termination of a rotating stroke of the operating handle is provided. The operating leg portion further includes a shake preventing protrusion on a free end side of the stopper protrusion.

5 Claims, 5 Drawing Sheets

VEHICLE HANDLE APPARATUS

BACKGROUND OF THE INVENTION

1. Field of the Invention

The present invention relates to a handle apparatus for a vehicle.

2. Background Art

JP-A-2008-013962 discloses a handle apparatus of a so-called gripping type in which a gripping portion formed in an intermediate part of an operating handle is held to open/close a door. In the handle apparatus, a guide arm portion (an operating leg) protrudes from a rotating end of the operating handle having the other end which is pivotally coupled to a base member (a handle base). The guide arm is inserted into a rotation guiding portion of the handle base.

A free end of the operating leg is provided with a slip preventing portion, and a stroke termination on a pull-out side of the operating handle is defined by an abutment of the slip preventing portion with a stopper portion formed in the rotation guiding portion.

Moreover, a guide wall portion protrudes from the handle base. In the case in which the operating handle is placed in an initial position, the guide wall portion is inserted into the operating handle in order to prevent a shake of the operating handle when the operating handle is pulled out up to the stroke termination on the pull-out side.

However, in the handle apparatus, the shake of the operating handle at the stroke termination on the pull-out side is prevented by extending the guide wall portion toward a surface side. Therefore, there is a problem in that the guide wall portion protruding from the handle base is exposed to an outside in the pull-out of the operating handle, which causes a poor appearance.

SUMMARY OF THE INVENTION

One or more embodiments of the invention provides a door handle apparatus for a vehicle which can prevent a shake of an operating handle in a pull-out position without deteriorating an appearance.

A door handle apparatus is provided with a handle base 1 fixed to a door of a vehicle and an operating handle 2 having one end which is pivotally coupled to the handle base 1. The operating handle 2 is a gripping type in which a rotating operation is carried out from an initial position to a pull-out position by gripping an intermediate portion, and an operating leg 5 inserted into a door protrudes from a rotating end of the operating handle 2.

The operating leg 5 has a stopper protrusion 4 and a shake preventing protrusion 6 located on a tip end of the operating leg 5. The stopper protrusion 4 butts with a stroke stopper 3 of the handle base 1 when the operating handle 2 is rotated and operated toward a pull-out position side, and a stroke termination on a pull-out side is defined.

A movement in a shaking direction of the shake preventing protrusion 6 is regulated by a second guiding portion 8 formed on the handle base 1 when the operating handle 2 rotates to the pull-out position, and a shaking range of the operating handle 2 is regulated by the first and second guide portions 7 and 8 disposed at a predetermined interval.

By further extending the operating leg 5 from the stopper protrusion 4 in a direction of a free end to form the shake preventing protrusion 6 on the free end, it is possible to set the interval between the first and second guide portions 7 and 8 to be larger. Therefore, it is possible to decrease a shaking angle of the operating handle 2. Thus, it is possible to decrease an amount of the shake.

As another method of decreasing the shake of the operating handle 2 in the pull-out position, it can also be supposed that the stopper protrusion 4 exactly extends toward a back side (in the specification, the pull-out direction of the operating handle 2 and an opposite direction thereto will be hereinafter referred to as a "front side" and a "back side", respectively), and the free end butts against a butting surface set to the handle base 1 and is thus utilized as a shake regulating portion. With the structure, however, it is impossible to achieve an effective prevention of the shake.

More specifically, the handle base 1 is a member which is generally manufactured by injection molding using a synthetic resin material and is fixed to a door panel. Therefore, a projection area of a surface provided along a door panel surface is large. In the case in which the handle base 1 is exposed to the door panel surface, furthermore, it serves as an appearance surface. For this reason, a parting surface of molds is set onto surfaces provided along the door panel surface. On the other hand, since the stopper protrusion 4 has a moving direction in an almost orthogonal direction to the parting surface, an inclination in a direction in which a width is gradually increased toward the termination is set onto a butting surface on the handle base 1 side.

As a result, a peripheral edge of an end face on the surface side of the stopper protrusion 4 effectively acts on the shaking regulation of the operating handle 2, and an edge on the back side of the stopper protrusion 4 does not effectively function for the shaking regulation.

In the embodiments of the invention, the stopper protrusion 4 extends to the back side to form the shake preventing protrusion 6 on the free end. Furthermore, in the handle base 1, there is provided the second guide portion 8 for regulating a movement in a shaking direction of the shake preventing protrusion 6 when the operating handle 2 rotates and is operated up to the pull-out position. Thus, the shake preventing protrusion 6 is considered to reliably function. As a result, it is possible to reliably ensure the interval between the first and second guide portions 7 and 8. Consequently, it is possible to effectively prevent the shake.

In the case in which a cover piece 9 for forming the second guide portion 8 is extended in a direction of the back face and is thus caused to correspond to a rear edge of the operating leg 5 when the operating handle 2 is placed in the initial position, it is desirable to ensure a sufficient water flowing gap 10 between an internal wall surface of the cover piece 9 and the shake preventing protrusion 6. The water flowing gap 10 is disposed for preventing an operation of the operating handle 2 from being carried out with difficulty due to freezing of waterdrops entering a part between the cover piece 9 and the shake preventing protrusion 6, and can be formed by providing a sufficient interval for non-adhesion of the waterdrops to both of wall surfaces through a surface tension or an elimination of the adhesion state in a comparatively early stage by dropping or flow if any between the internal wall surface of the cover piece 9 and a sidewall surface of the shake preventing protrusion 6.

Although the water flowing gap 10 can also be formed stepwise, if the water flowing gap 10 is formed by a continuous inclined surface, it is possible to reliably prevent catching in an operation. In this case, it is possible to easily form the water flowing gap 10 by setting an internal wall surface reaching the free end of the cover piece 9 from a termination on the free end side of the second guide portion 8 in the cover piece 9 to be a surface having a large gradient.

According to the structure of the embodiments of the invention, it is possible to regulate a shake of an operating handle in a pull-out position without deteriorating an appearance in a pull-out operation of the operating handle in order to prevent the shake by utilizing an internal space of a door.

Other aspects and advantages of the invention will be apparent from the following description, the drawings and the claims.

DETAILED DESCRIPTION OF THE EXEMPLARY EMBODIMENTS

An exemplary embodiment of the invention is described with reference to drawings.

Figure 1:
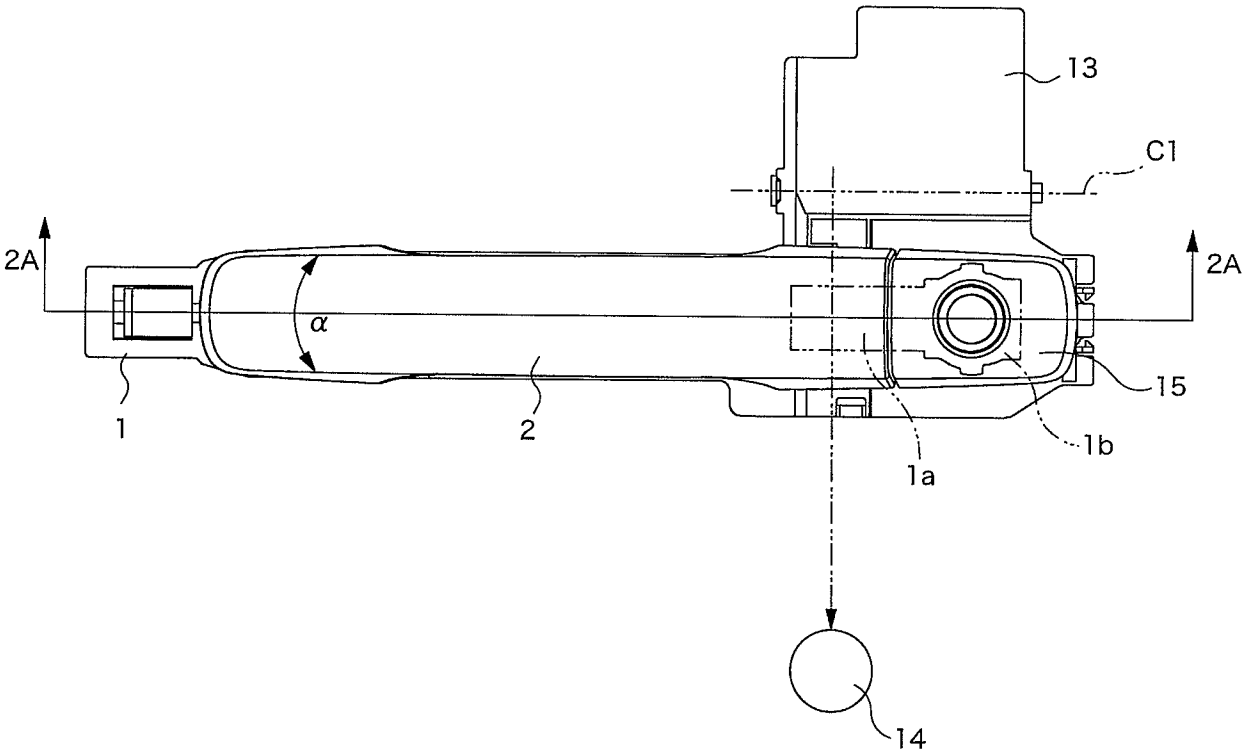
FIG. 1 is a front view showing a door handle apparatus.

As shown in FIG. 1 and subsequent drawings, a handle apparatus includes a handle base 1 and an operating handle 2 having one end which is pivotally coupled to the handle base 1. The handle apparatus is attached to a door in such a posture that a left side in FIG. 1 directs to a front side of a vehicle.

The operating handle 2 includes a hinge protrusion 2*a* on a front end (the direction of the front side of the vehicle will be hereinafter referred to as "front" based on an attaching posture to the vehicle) and an operating leg 5 on a rear end. Thus, the operating handle 2 is constituted as an operating handle of a so-called gripping type in which a central part is grasped to carry out an operation. The operating handle 2 is pivotally coupled to the handle base 1 at the hinge protrusion 2*a*. The operating leg 5 is inserted and attached into an inner part of a door. The operating leg 5 is movable in a direction of a thickness of the door (a surface and back direction) through a rotating operation around a rotation center C2.

Figure 3A:
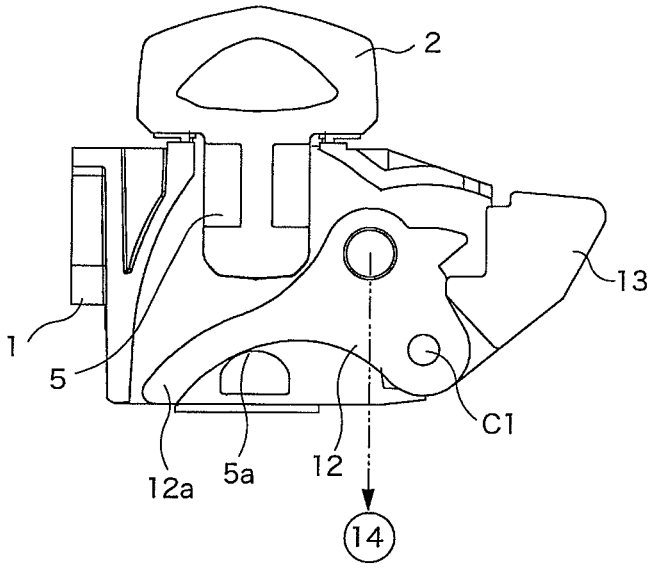
FIG. 3A is a sectional view taken along a 3A-3A line in FIG. 2 and showing an initial state.
Figure 3B:
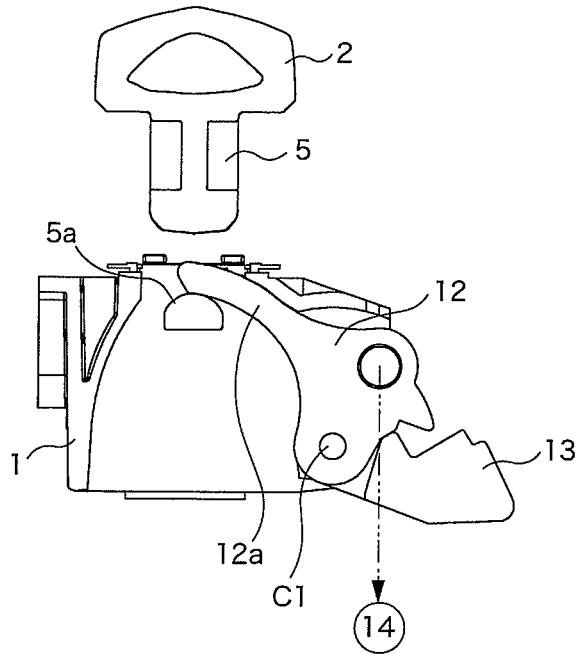
FIG. 3B is a view showing a pull-out state of the door handle apparatus.

A lever 12 is coupled to the handle base 1. The lever 12 is rotatable around a rotation center C1 between an initial position shown in FIG. 3A and an operation rotating position shown in FIG. 3B. The lever 12 has an operating protrusion 12*a* to be engaged with an engaging step portion 5*a* of the operating leg 5 and is energized toward a side of the initial position. A counter weight 13 is coupled to the lever 12. The counter weight 13 serves to offset an inertia force generated on the operating handle 2 when a lateral collision force is loaded onto a vehicle.

Figure 2A:
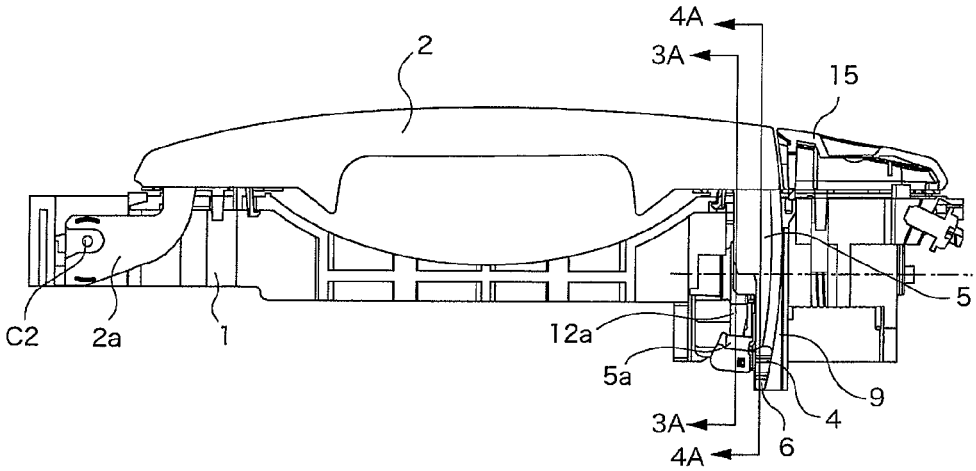
FIG. 2A is a sectional view taken along a 2A-2A line in FIG. 1 and showing an initial state of the door handle apparatus.
Figure 2B:
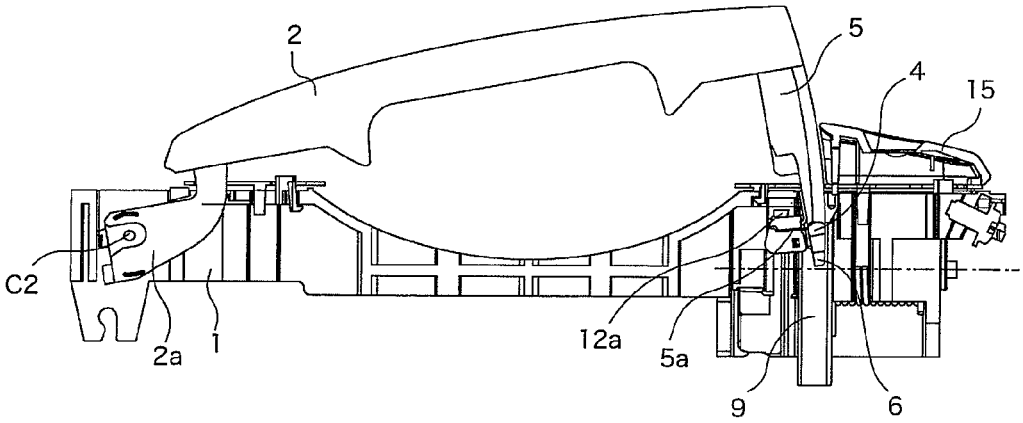
FIG. 2B is a view showing a pull-out state of the door handle apparatus.

When the operating handle 2 rotates from the initial position shown in FIG. 2A to the pull-out position shown in FIG. 2B, the operating protrusion 12*a* is pushed up toward the operating leg 5 so that the lever 12 rotates and a door locking device 14 disposed in the door is operated.

FIGS. 4A to 5D show the details of the operating leg 5. The operating leg 5 has a stopper protrusion 4 which is bulged on an opposite sidewall, that is, an orthogonal surface to the rotation center C2 of the operating handle 2. The operating leg 5 also has a shake preventing protrusion 6. The operating leg 5 is inserted into a leg insertion opening 1*a* formed on the handle base 1 and is thus introduced into the door. Referring to the stopper protrusion 4 and the shake preventing protrusion 6, the stopper protrusion 4 is positioned on a front side, and the shake preventing protrusion 6 is disposed on a free end of the operating leg 5. A concave portion 11 is formed between the stopper protrusion 4 and the shake preventing protrusion 6.

In order to enable an insertion of the stopper protrusion 4 and the shake preventing protrusion 6 in the operating leg 5, a width increasing portion 1*b* is provided to a rear end of the leg insertion opening 1*a* as shown in a chain line of FIG. 1. The operating handle 2 is attached by sliding it in the front side after the operating leg 5 is inserted from the width increasing portion 1*b*. After the attachment of the operating handle 2, the width increasing portion 1*b* is closed by a cap member 15 coupled to the handle base 1.

Figure 4A:
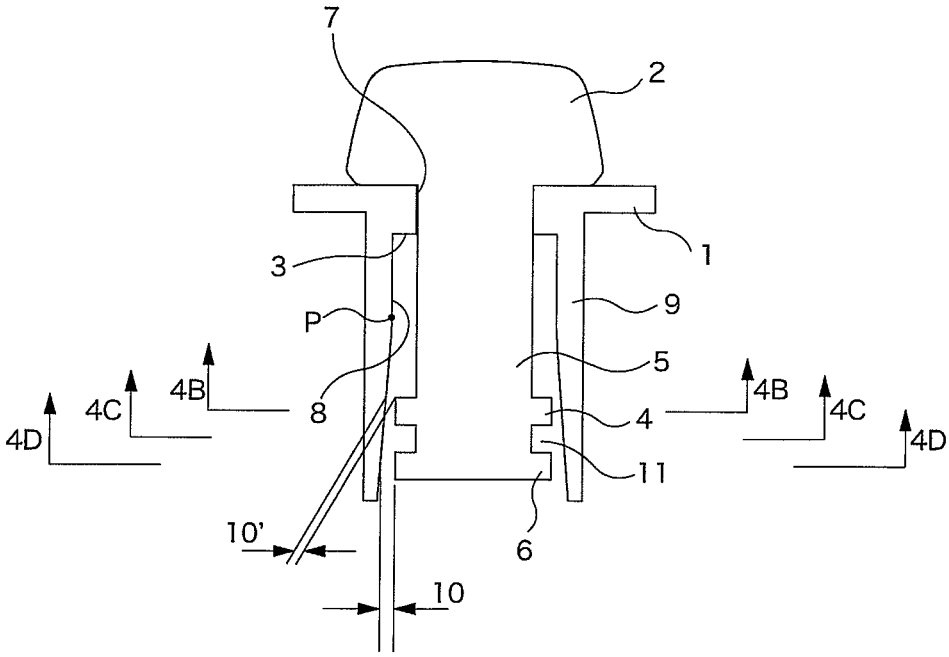
FIG. 4A is a sectional view taken along a 4A-4A line in FIG. 2A.
Figure 4B:
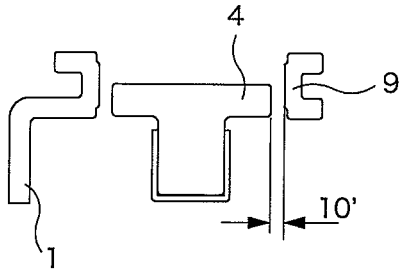
FIG. 4B is a sectional view taken along a 4B-4B line in FIG. 4A.
Figure 4C:
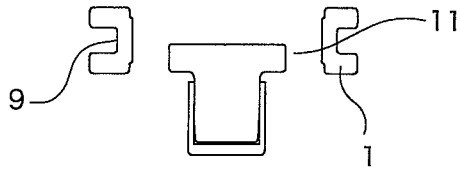
FIG. 4C is a sectional view taken along a 4C-4C line in FIG. 4A.
Figure 4D:
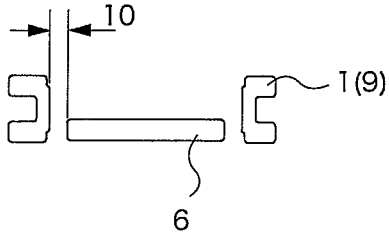
FIG. 4D is a sectional view taken along a 4D-4D line in FIG. 4A.
Figure 5A:
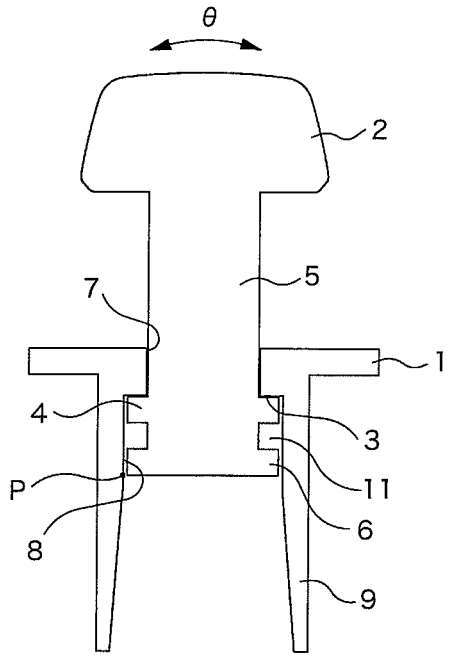
FIG. 5A is a view corresponding to FIG. 4A and showing an operating leg 5 in a pull-out position.
Figure 5B:
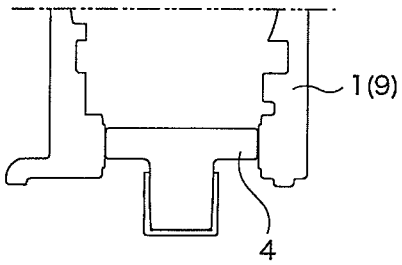
FIG. 5B is a view corresponding to FIG. 4B and showing the operating leg 5 in the pull-out position.
Figure 5C:
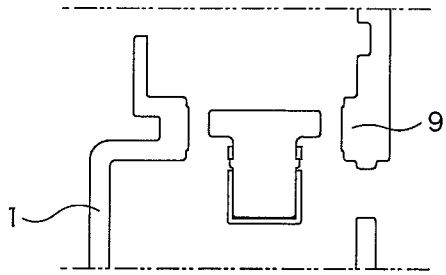
FIG. 5C is a view corresponding to FIG. 4C and showing the operating leg 5 in the pull-out position.
Figure 5D:
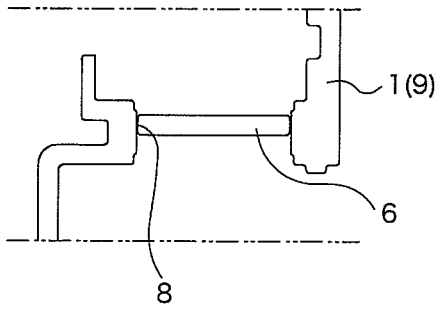
FIG. 5D is a view corresponding to FIG. 4D and showing the operating leg 5 in the pull-out position.

As shown in FIGS. 4A and 5A, a width of an opening end at a surface side (an upper side in FIGS. 4A and 5A) of the leg insertion opening 1*a* is set to be a dimension capable of regulating a movement of a sidewall of a general part of the operating leg 5 when the operating handle 2 is operated up to the pull-out position. Thus, a first guide portion 7 is formed.

Moreover, a cover piece 9 is protruded from the handle base 1 on a back side (a lower side in FIGS. 4A and 5A) at an interval substantially corresponds to a dimension between sidewalls of the stopper protrusion 4. A stroke stopper 3 is set at a base end of the cover piece 9. As shown in FIG. 5A, the stopper protrusion 4 abuts on the stroke stopper 3 when the operating handle 2 is rotated in the pull-out direction. Thus, the stroke termination is determined.

In the handle base 1 of the embodiment which is formed as an injection molded product (for example, a synthetic resin material) manufactured by injection molding using molds where a parting surface of the molds is substantially orthogonal to the surface and back direction (a up-down direction in FIGS. 4A and 5A), a proper draft (inclination) is set to the internal wall surface of the cover piece 9. As shown in FIG. 5A, a draft surface is set between the base end of the cover piece 9 and a point P of the internal wall surface of the cover piece 9 which corresponds to a position of the shake preventing protrusion 6 when the operating handle 2 is operated up to the pull-out position. In a part of the internal wall surface of the cover piece 9 from the point P to the free end of the cover piece 9, a large gradient surface having a larger inclination angle than the draft is formed. For easy understanding, on a converting position from the draft into the large gradient surface, a reference character P is indicated on FIG. 5A.

A width of the draft surface at the base end of the cover piece 9 is set to be substantially equal to a width of the shake preventing protrusion 6, so that a second guide portion 8 is formed.

In the embodiment, accordingly, when it is placed in the initial position, the operating handle 2 is energized toward the back side by an energizing force acting on the lever 12 and is thus pushed against the surface of the handle base 1. Furthermore, the movement of the general part of the operating leg 5 is regulated by the first guide portion 7 so that the shake or an unsteadiness can be prevented from being caused.

Moreover, it is possible to avoid a problem in that rainwater or car washing water stays and freezes and the operation of the operating handle 2 is thus disabled because proper intervals (water flowing gaps 10' and 10) are formed between the cover piece 9 and the stopper protrusion 4 and between the cover piece 9 and the shake preventing protrusion 6 as shown in FIG. 4.

When the operating handle 2 is moved from the initial position to the pull-out position, the shake of the operating leg 5 of the operating handle 2 in a swinging direction (an a direction in FIG. 1) or a rotating direction (a θ direction in FIG. 5) can be prevented by the first guide portion 7 and the second guide portion 8 which are positioned at a predetermined interval.

While description has been made in connection with specific exemplary embodiment of the invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

1 handle base
2 operating handle
3 stroke stopper
4 stopper protrusion
5 operating leg
6 shake preventing protrusion
7 first guide portion
8 second guide portion
9 cover piece
10 water flowing gap
11 concave portion

What is claimed is:

1. A door handle apparatus for a vehicle comprising:
a handle base to be fixed to a door of the vehicle;
a stroke stopper formed on the handle base;
an operating handle, wherein one end of the operating handle is pivotally coupled to the handle base and the operating handle is rotatable between an initial position and a pull-out position;
an operating leg provided on the other end of the operating handle and protruding toward an inner part of the door;
a stopper protrusion provided on the operating leg intermediate proximal and distal ends of the operating leg and configured to define a termination of a rotating stroke of the operating handle on a pull-out side by an abutment of the stopper protrusion with the stroke stopper;
a shake preventing protrusion formed on the distal end of the operating leg, the stopper protrusion and the shake preventing protrusion being spaced apart along the length of operating leg;
a first guide portion provided on the handle base; and
a second guide portion provided on the handle base,
wherein, when the operating handle positions in the pull-out position, the first guide portion is configured to regulate a movement of an intermediate part of the operating leg and the second guide portion is configured to regulate a movement of the shake preventing protrusion, to prevent a shake of the operating handle.

2. The door handle apparatus according to claim 1, further comprising:
a cover piece which protrudes from the handle base, wherein the cover piece is opposed o the operating leg, wherein the cover piece is extending to a vicinity of the distal end of the operating leg in the initial position, and wherein the second guide portion is provided on an internal wall of the cover piece; and
a gap provided between an internal wall of the cover piece and the shake preventing protrusion in the initial position.

3. The door handle apparatus according to claim 2, wherein the internal wall between a free end of the cover piece and an end of the second guide portion on a side of the free end of the cover piece is formed by a gradient surface.

4. A door handle apparatus according to claim 1, wherein a groove is provided between the stopper protrusion and the shake preventing protrusion which are spaced apart along the length of operating leg.

5. A door handle apparatus comprising:
a handle base to be fixed to a door of a vehicle;
a stroke stopper formed on the handle base;
an operating handle, wherein one end of the operating handle is pivotally coupled to the handle base and the operating handle is rotatable between an initial position and a pull-out position;
an operating leg provided on the other end of the operating handle and protruding toward an inner part of the door;
a stopper protrusion provided on the operating leg intermediate proximal and distal ends of the operating leg and configured to define a termination of a rotating stroke of the operating handle on a pull-out side by an abutment of the stopper protrusion with the stroke stopper;
a shake preventing protrusion formed on the distal end of the operating leg; and
a cover piece which protrudes toward the inner part of the door from the handle base to a vicinity of the distal end of the operating leg in the initial position and is opposed to the operating leg.

* * * * *